US009885202B2

(12) United States Patent
Laible

(10) Patent No.: US 9,885,202 B2
(45) Date of Patent: Feb. 6, 2018

(54) REFRIGERATOR COMPRISING A PLASTIC FRONT FRAME

(75) Inventor: Karl-Friedrich Laible, Langenau (DE)

(73) Assignee: BSH Hausgeräte GmbH, Munich (DE)

( * ) Notice: Subject to any disclaimer, the term of this patent is extended or adjusted under 35 U.S.C. 154(b) by 1472 days.

(21) Appl. No.: 11/919,569

(22) PCT Filed: Apr. 7, 2006

(86) PCT No.: PCT/EP2006/061447

§ 371 (c)(1),
(2), (4) Date: Oct. 29, 2007

(87) PCT Pub. No.: WO2006/120106

PCT Pub. Date: Nov. 16, 2006

(65) Prior Publication Data

US 2009/0314028 A1 Dec. 24, 2009

(30) Foreign Application Priority Data

May 11, 2005 (DE) ..... 10 2005 022 515

(51) Int. Cl.

| | |
|---|---|
| ***A47B 96/04*** | (2006.01) |
| ***E05C 19/16*** | (2006.01) |
| ***F25D 23/08*** | (2006.01) |

(52) U.S. Cl.

CPC ..... *E05C 19/161* (2013.01); *F25D 23/087* (2013.01); *F25D 23/085* (2013.01)

(58) Field of Classification Search

USPC ..... 312/405, 296, 326–329; 292/251.5, 292/DIG. 71; 49/475.1, 478.1

See application file for complete search history.

(56) References Cited

U.S. PATENT DOCUMENTS

| | | | | |
|---|---|---|---|---|
| 2,745,259 | A * | 5/1956 | Saunders | 62/266 |
| 3,294,462 | A * | 12/1966 | Kesling | 312/405 |
| 3,359,053 | A * | 12/1967 | Hagendoorn | 312/296 |
| 4,732,432 | A * | 3/1988 | Keil et al. | 312/406.2 |
| 4,884,415 | A * | 12/1989 | Mandel et al. | 62/277 |
| 5,349,832 | A * | 9/1994 | Johnson et al. | 62/447 |
| 6,056,383 | A * | 5/2000 | Banicevic et al. | 312/406 |
| 6,464,312 | B1 | 10/2002 | Tenhundfeld et al. | |
| 6,845,545 | B2 * | 1/2005 | Han et al. | 16/277 |

(Continued)

FOREIGN PATENT DOCUMENTS

| | | |
|---|---|---|
| EP | 1 170 562 | 1/2002 |
| EP | 1 180 654 | 2/2002 |
| EP | 1 462 741 | 9/2004 |

OTHER PUBLICATIONS

International Search Report PCT/EP2006/061447.

*Primary Examiner* — Daniel J Troy
*Assistant Examiner* — Andres F Gallego
(74) *Attorney, Agent, or Firm* — Nixon & Vanderhye, PC

(57) ABSTRACT

The invention relates to a refrigerating device having a cooled goods compartment and a door. The cooled goods compartment is provided with a front frame that is made of a low heat-conducting material such as plastic or similar and is backed by a first magnet. A door seal that is fitted with a second magnet seals against the front frame in the closed position of the door. Opposite first poles of the two poles of each magnet face the contact area between the seal and the front frame while second poles face away from the contact area.

13 Claims, 2 Drawing Sheets

(56) References Cited

U.S. PATENT DOCUMENTS

| | | | | |
|---|---|---|---|---|
| 2001/0003408 | A1* | 6/2001 | Otto et al. | 312/407 |
| 2002/0194861 | A1* | 12/2002 | Shin | 62/440 |
| 2004/0104654 | A1* | 6/2004 | Lee et al. | 312/401 |
| 2004/0108798 | A1* | 6/2004 | Laible | 312/405 |
| 2004/0189165 | A1 | 9/2004 | An | |
| 2006/0250061 | A1* | 11/2006 | Cheon | 312/401 |

* cited by examiner

Fig. 1
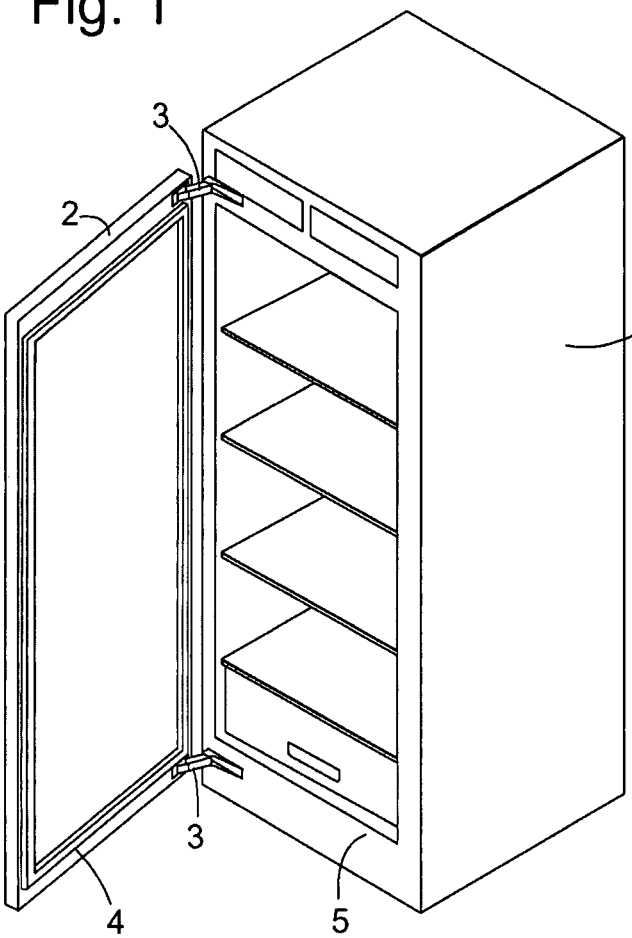
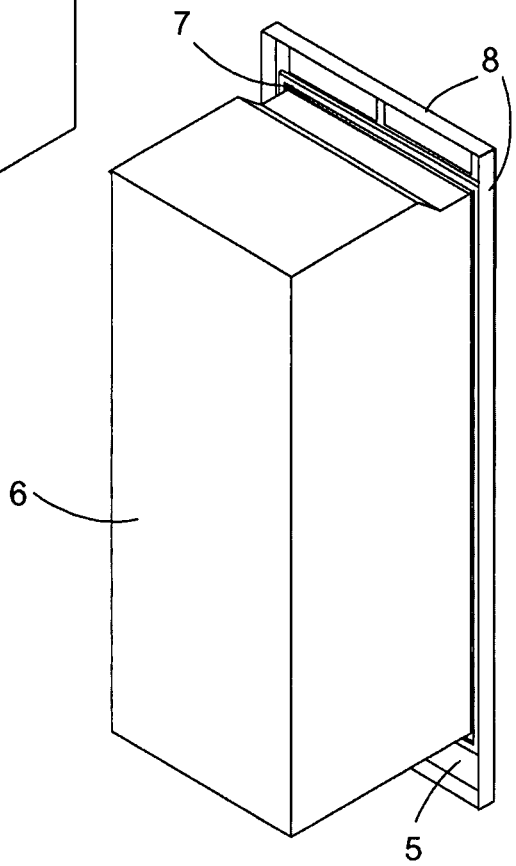
Fig. 2

REFRIGERATOR COMPRISING A PLASTIC FRONT FRAME

This application is a U.S. National Phase of International Patent Application No. PCT/EP2006/061447, filed Apr. 7, 2006, which designates the U.S. and claims priority to German Patent Application No. DE 10 2005 022 515.2, filed May 11, 2005, the entire contents of each of which are hereby incorporated by reference.

The present invention relates to a refrigerating device that has a carcass and a door and in which the carcass has a front frame made of plastic. A front frame of said type is used in particular in refrigerating devices in which an inner container and an outer skin are both made of metal, to prevent a cold bridge between the inner container and outer skin.

A refrigerating device's door conventionally has a flexible seal that is fitted with a magnet and which, when the door is closed, is applied tightly against the front frame towards which it is pulled by magnetic force. If the front frame is made not of a ferromagnetic metal sheet but of plastic, then a ferromagnetic material that is attracted by the seal's magnet can be attached only behind the front frame, as a result of which the minimum distance between the magnet and ferromagnetic material will increase by the extent of the front frame's material thickness and the attraction substantially decreased. To combat that problem it has been proposed attaching a permanent magnet behind the front frame in place of the conventional ferromagnetic though not magnetized material. Because the magnet in the seal is conventionally arranged with its two poles equidistant from the front frame, the magnet behind the front frame must be positioned antiparallel thereto to ensure an attraction between the two. The problem therein arises that if the two magnets are not in exact mutual alignment, like poles can assume adjacent positions so that the magnets will repel instead of attract each other. If that is the case only along a part the seal's length, there will in places be seal leakages between the front frame and door; it can in extreme cases lead to the door's no longer closing firmly.

Said problem arises especially along horizontally extending sections of the seal because of the particularly high risk there of a repulsion-inducing misalignment of the magnets due to, for instance, varyingly heavily loading storage shelves mounted on the door.

The object of the present invention is to eliminate the risk of the two magnets' repelling each other in a refrigerating device in which a front frame is backed by a magnet.

Said object is achieved by means of a refrigerating device that has a carcass and a door and in which the carcass has a plastic front frame that is backed by a first magnet and against which, when the door is in the closed position, a door seal fitted with a second magnet will close tightly, with of each magnet's two poles in each case unlike first poles facing the contact area between the seal and front frame and second poles facing away from said contact area.

The plastic front frame is owing to its poor heat-conducting properties especially expediently used in a refrigerating device having a metallic inner container and a metallic outer skin.

The above-described mutual alignment of the magnets is furthermore especially expedient in the case of a refrigerating device whose door and carcass are linked by means of a multi-link hinge, because the risk that the door will, under load, sag substantially parallel to the carcass or sag more at its free, non-fastened end and so in any event become displaced is relatively high in the case of that type of hinge. That is because, notwithstanding said sagging, it will always be ensured by the inventive magnet arrangement that the seal is applied tightly against the contact area on the front frame by the magnetic force.

The arrangement of the magnets having unlike first poles facing the contact area and unlike second poles facing away from the contact area can be realized around the seal's entire circumference. Said arrangement will, though, be particularly advantageous along a section of the seal extending horizontally. The above-described antiparallel arrangement of a third magnet provided on the seal and of a fourth magnet located behind the front frame can in the case of a parallel displacement—because the risk of a misalignment that will prevent the magnetic seal from being applied tightly against the front frame will then be substantially less—also be provided along a vertically extending section.

Further features and advantages of the invention will emerge from the following description of exemplary embodiments with reference to the attached figures.

FIG. 1 is a perspective view of a refrigerating device to which the present invention can be applied;

FIG. 2 is a view of the inner container and front frame of the refrigerating device shown in FIG. 1;

Figure 3:
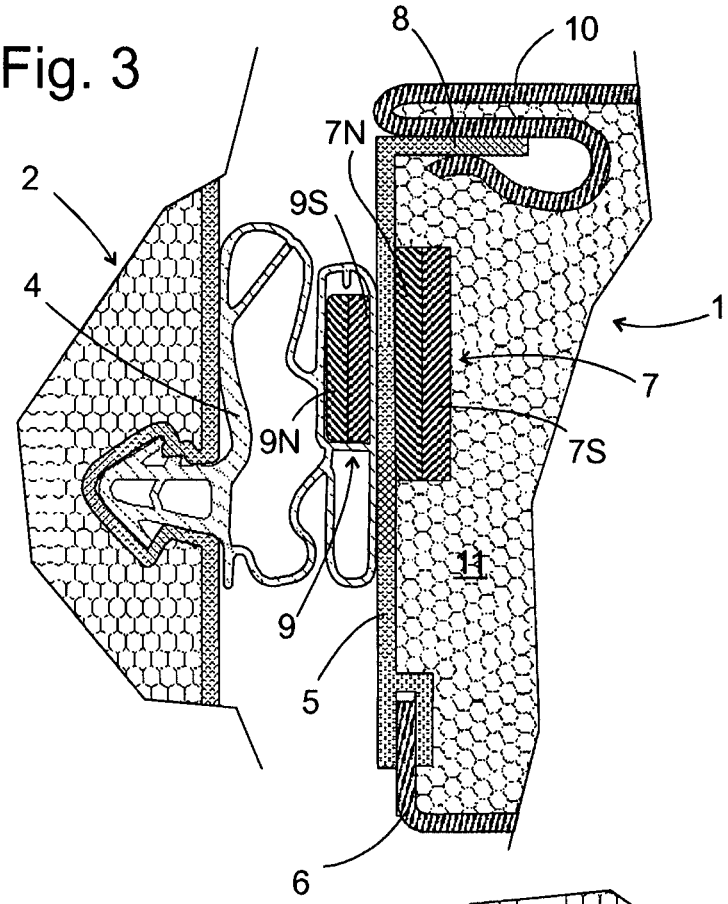
FIG. 3 shows a section through a horizontal part of the magnetic seal and its ambient area in the refrigerating device shown in FIG. 1.

FIG. 1 shows a refrigerating device having a carcass 1 and a door 2 fastened to the carcass via multi-link hinges 3. The door has on its interior side a magnetic seal 4 forming a rectangular frame, a multi-chambered hollow section made of flexible plastic in one of whose chambers a magnet is housed. Not shown in order to simplify the representation are storage shelves mounted in the door for accommodating items being chilled; they can, though, be present.

With the door in the closed position the magnetic seal 4 is applied against a plastic front frame 5 forming the front side of the carcass 1.

FIG. 2 is a perspective rear view of the front frame 5 and the inner container 6, mounted thereon, assembled from a plurality of metal sheets. Arranged in the shape of a frame on the rear side of the front frame and surrounding the inner container's opening is a magnet 7. Said magnet can be assembled from a plurality of individual pieces. Webs 8 bent at right angles and formed as a single piece on the edge of the front frame 5 serve to secure the outer skin, not shown in FIG. 2, assembled like the inner container 6 from metal sheets.

FIG. 3 shows a section along a vertical plane through the front frame 5 at the height of the cover of the carcass 1 and the door 2 being applied against the front frame. To be seen is the magnetic seal 4 that is latched into the door 2 in a manner known per se. A magnet 9 is housed in one of the chambers of the plastic hollow section of the magnetic seal 4.

The front frame 5 is linked in each case by means of a slot-and-key connection to the inner container 6 and the outer skin 10; a space between the inner container 6 and outer skin 10 is filled with insulating foam 11. A magnet 7 is embedded on the rear side of the front frame 5 into the insulating foam 11.

The poles 7N, 7S, 9N, 9S of the magnets 7, 9 are identified in the figure by two different types of shading, with like poles being in each case provided with the same shading. The poles 9S, 7N are facing the contact area between the magnetic seal 4 and front frame 5; the poles 9N, 7S are facing away therefrom. It can readily be appreciated that the attraction between the magnets 7, 9 is independent of whether the height of the door 2 varies relative to the carcass 1, so long as it is ensured that the magnets 7, 9 are mutually opposite. The magnet 7 is here shown somewhat wider (or, in the perspective of FIG. 3, higher) than the magnet 9; its width can be made greater by the extent of an anticipated height tolerance for the door 2 than that of the magnet 9 in order to ensure that the magnet 9 will along its entire width (or, as the case may be, height) overlap the magnet 7 at any height that can be assumed by the door 2 so that a magnetic force sufficient for keeping the door 2 tightly sealed will occur that is substantially independent of any height misalignment within the range of said tolerance.

Figure 4:
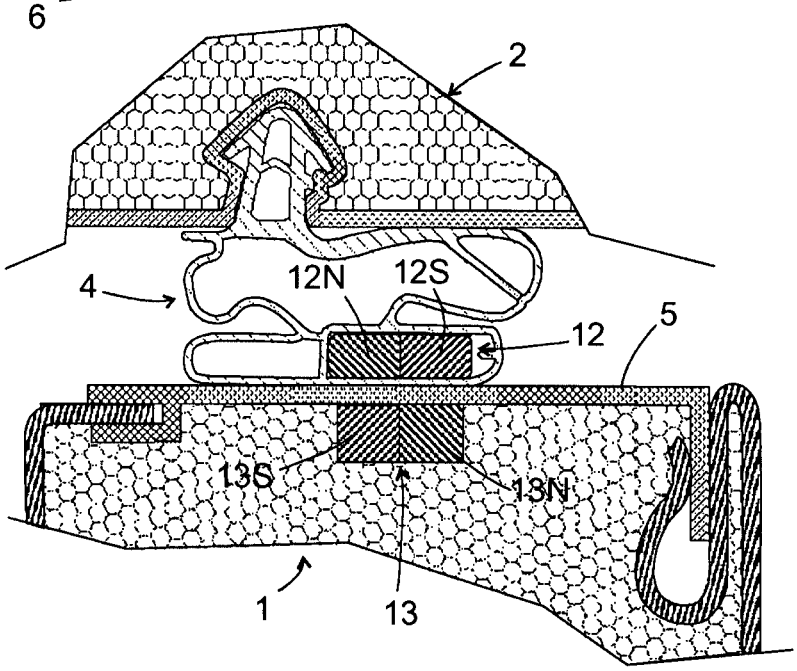
FIG. 4 shows a section through a vertical part of the seal and its ambient area according to a variant embodiment of the invention.

A horizontal section through the front frame 5 at the height of a side wall of the carcass 1 is, according to a first embodiment of the invention, identical to the section shown in FIG. 3. According to a second embodiment it is provided for magnets 12, 13 to be arranged, as shown in FIG. 4, antiparallel in the magnetic seal 4 and behind the front frame 5 with in each case unlike poles 12N, 12S, 13N, 13S lying in pairs opposite each other. As can readily be seen, the magnets 12, 13 would repel each other as soon as one of the magnets 12, 13 was out of alignment by more than one fourth of its width relative to the position shown. That, though, will be acceptable in the case of the here vertically extending section of the magnetic seal 4 because only a horizontal mutual misalignment of the magnets can lead here to repulsion, and such a misalignment is not to be expected to any critical extent even when the door 2 is heavily laden. Compared with the horizontal sections shown in FIG. 3, material costs can, however, be saved here because with the pole arrangement shown in FIG. 4 a smaller cross-sectional area of the magnets will suffice to achieve the same magnetic attraction per unit of length of the seal as in the case shown in FIG. 3.

The invention claimed is:

1. A refrigerating device comprising:

a cooled goods compartment configured to receive goods to be cooled, the cooled goods compartment having a front frame, said cooled goods compartment having an opening comprising a pair of horizontal sides and a pair of vertical sides, said front frame disposed along each of the pair of horizontal sides and each of the pair of vertical sides; and a door movable between an open position and a closed position relative to the cooled goods compartment, the door having a seal element comprising a pair of horizontal sides and a pair of vertical sides, each of the pair of horizontal sides and each of the pair of vertical sides of the seal element configured to be in sealing engagement with respective ones of the pair of horizontal sides and the pair of vertical sides of the front frame when the door is in its closed position, and the door being displaceable in a vertical direction relative to the cooled goods compartment within a predetermined height tolerance, wherein the cooled goods compartment comprises a first magnet disposed within each of the pair of horizontal sides of the front frame and the door comprises a second magnet disposed within each of the pair of horizontal sides of the seal element, wherein the first magnet has a pole and an oppositely signed pole and the second magnet has a pole and an oppositely signed pole, wherein the first magnet and the second magnet are oriented such that the pole of the first magnet adjacent the second magnet has a sign opposite a sign of the pole of the second magnet adjacent the first magnet, wherein the oppositely signed pole of the first magnet faces away from the second magnet and the oppositely signed pole of the second magnet faces away from the first magnet, wherein one of the first magnet and the second magnet is taller than the other in a vertical direction at least to the extent of said predetermined height tolerance to ensure overlap between the first magnet and the second magnet within the range of said predetermined height tolerance when the door is in the closed position to maintain the sealing engagement between respective ones of the pair of horizontal sides of the front frame and the pair of horizontal sides of the sealing element, wherein the door comprises a third magnet disposed within each of the pair of vertical sides of the seal element and the cooled goods compartment comprises a fourth magnet disposed within each of the pair of vertical sides of the front frame, wherein the third magnet and the fourth magnet each has a pole and an oppositely signed pole, and wherein the third magnet and the fourth magnet are oriented such that the poles of the third magnet are adjacent to respective poles of the fourth magnet having signs opposite to signs of the poles of the third magnet when the door is in the closed position, irrespective of vertical displacement of the door relative to the opening of the cooled goods compartment.

2. The refrigerating device as claimed in claim 1, wherein the door and the cooled goods compartment are joined with at least one multi-link hinge to allow the door to move between the open position and the closed position.

3. The refrigerating device as claimed in claim 2, wherein the door comprises at least one shelf to hold goods to be cooled in the cooled goods compartment when the door is in the closed position.

4. The refrigerating device as claimed in claim 3, wherein the door is displaceable in a vertical direction relative to the opening of the cooled goods compartment due to displacement of the at least one multi-link hinge caused by loading of the at least one shelf.

5. The refrigerating device as claimed in claim 2, wherein the predetermined height tolerance between the door and the opening of the cooled goods compartment is greatest at a side of the door laterally opposite from the at least one multi-link hinge.

6. The refrigerating device as claimed in claim 1, wherein the cooled goods compartment includes a metallic inner container and a metallic outer skin and the front frame of the cooled goods compartment is configured to link the metallic inner container to the metallic outer skin, and wherein the front frame is formed of a material having a relatively low thermal conductivity compared to the metallic inner container and the metallic outer skin.

7. The refrigerating device as claimed in claim 1, wherein the third magnet and the fourth magnet have substantially equal cross-sectional dimensions.

8. A refrigerating device comprising:

a cooled goods compartment configured to receive goods to be cooled, the cooled goods compartment having a front frame, said cooled goods compartment having an opening comprising a pair of horizontal sides and a pair of vertical sides, said front frame disposed along each of the pair of horizontal sides and each of the pair of vertical sides; and a door movable between an open position and a closed position relative to the cooled goods compartment, the door having a seal element comprising a pair of horizontal sides and a pair of vertical sides, each of the pair of horizontal sides and each of the pair of vertical sides of the seal element configured to be in sealing engagement with respective ones of the pair of horizontal sides and the pair of vertical sides of the front frame when the door is in its closed position, wherein the cooled goods compartment comprises a first magnet disposed within each of the pair of horizontal sides of the front frame and the door comprises a second magnet disposed within each of the pair of horizontal sides of the seal element, wherein the first magnet has a pole and an oppositely signed pole and the second magnet has a pole and an oppositely signed pole, wherein the first magnet and the second magnet are shaped, dimensioned, and oriented such that the pole of the first magnet, having the same sign as the pole of the second magnet, are not adjacent one another when the door is in the closed position and displaced in a vertical direction relative to the opening of the cooled goods compartment, wherein a height difference between the first magnet and the second magnet in the vertical direction is at least the extent of a predetermined height tolerance between the door and the opening of the cooled goods compartment to ensure overlap between the first magnet and the second magnet within the range of said predetermined height tolerance when the door is in the closed position to maintain the sealing engagement between respective ones of the pair of horizontal sides of the front frame and the pair of horizontal sides of the sealing element, wherein the door comprises a third magnet disposed within each of the pair of vertical sides of the seal element and the cooled goods compartment comprises a fourth magnet disposed within each of the pair of vertical sides of the front frame, wherein the third magnet and the fourth magnet each has a pole and an oppositely signed pole, and wherein the third magnet and the fourth magnet are oriented such that the poles of the third magnet are adjacent to respective poles of the fourth magnet having signs opposite to signs of the poles of the third magnet when the door is in the closed position, irrespective of vertical displacement of the door relative to the opening of the cooled goods compartment.

9. The refrigerating device as claimed in claim 8, wherein the door and the cooled goods compartment are joined with at least one multi-link hinge to allow the door to move between the open position and the closed position.

10. The refrigerating device as claimed in claim 9, wherein the door comprises at least one shelf to hold goods to be cooled in the cooled goods compartment when the door is in the closed position.

11. The refrigerating device as claimed in claim 10, wherein the door is displaceable in a vertical direction relative to the opening of the cooled goods compartment due to displacement of the at least one multi-link hinge caused by loading of the at least one shelf.

12. The refrigerating device as claimed in claim 8, wherein the cooled goods compartment includes a metallic inner container and a metallic outer skin and the front frame of the cooled goods compartment is configured to link the metallic inner container to the metallic outer skin, and wherein the front frame is formed of a material having a relatively low thermal conductivity compared to the metallic inner container and the metallic outer skin.

13. The refrigerating device as claimed in claim 8, wherein the third magnet and the fourth magnet have substantially equal cross-sectional dimensions.

* * * * *